US012753930B2

(12) United States Patent
Barton

(10) Patent No.: US 12,753,930 B2
(45) Date of Patent: Oct. 6, 2026

(54) OVEN RACK

(71) Applicant: Monique Barton, Antioch, TN (US)

(72) Inventor: Monique Barton, Antioch, TN (US)

( * ) Notice: Subject to any disclaimer, the term of this patent is extended or adjusted under 35 U.S.C. 154(b) by 10 days.

(21) Appl. No.: 18/657,103

(22) Filed: May 7, 2024

(65) Prior Publication Data

US 2025/0347423 A1 Nov. 13, 2025

(51) Int. Cl.
*F24C 15/16* (2006.01)

(52) U.S. Cl.
CPC ..... *F24C 15/16* (2013.01)

(58) Field of Classification Search
CPC ..... F24C 15/16; F24C 15/168; F24C 15/164; A47B 55/02; A47B 96/025; A47B 2210/04; A47J 37/0664; A47J 37/0694; A47J 37/06; A47L 15/507; A47L 15/506; A47L 15/50
See application file for complete search history.

(56) References Cited

U.S. PATENT DOCUMENTS 2,091,607 A * 8/1937 Nave ..... F25D 25/02 211/153
2,156,214 A * 4/1939 Woodman ..... F24C 15/16 99/413
2,828,178 A * 3/1958 Dahlgren ..... F25D 23/04 312/328
2,994,463 A * 8/1961 Drader ..... B65D 21/0226 294/169
3,625,371 A * 12/1971 Dill ..... A47B 96/025 108/90
3,789,826 A * 2/1974 Baltz ..... F24C 15/16 126/339
4,437,572 A * 3/1984 Hoffman ..... F25D 25/02 211/119.003
6,390,310 B1 * 5/2002 Insalaco ..... A47F 5/0087 211/183
6,497,331 B1 * 12/2002 Morandi ..... A47B 55/02 211/90.03
7,198,340 B1 * 4/2007 Ertz ..... F25D 25/02 211/119.003
2007/0108146 A1 * 5/2007 Nawrocki ..... F16B 12/38 211/90.03
2010/0218755 A1 * 9/2010 Stewart ..... F24C 15/16 126/339

* cited by examiner

*Primary Examiner* — Hiwot E Tefera
(74) *Attorney, Agent, or Firm* — The Iwashko Law Firm, PLLC; Lev Ivan Gabriel Iwashko

(57) ABSTRACT

An oven rack, including a plurality of support members to support an object thereupon, a rear brace connected to rear portions of the plurality of support members such that the rear brace is disposed perpendicularly with respect to the plurality of support members, a front brace connected to front portions of the plurality of support members such that the front brace is disposed perpendicularly with respect to the plurality of support members, and a guard portion connected to the front portions of the plurality of support members.

1 Claim, 2 Drawing Sheets

OVEN RACK

BACKGROUND

1. Field

The present general inventive concept relates generally to an oven rack, and particularly, to an improved oven rack.

2. Description of the Related Art

Many individuals have encountered stressful moments when their pots or pans threaten to slide off a standard oven rack insert. This is a precarious situation that can lead to spilled food, damaged cookware, bodily harm, and messy post-accident cleanup.

Therefore, there is a need for an accessory that ensures cookware stability in the oven, at all times, allowing for improved cooking operation.

SUMMARY

The present general inventive concept provides an improved oven rack.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an oven rack, including a plurality of support members to support an object thereupon, a rear brace connected to rear portions of the plurality of support members such that the rear brace is disposed perpendicularly with respect to the plurality of support members, a front brace connected to front portions of the plurality of support members such that the front brace is disposed perpendicularly with respect to the plurality of support members, and a guard portion connected to the front portions of the plurality of support members, the guard portion including a plurality of curved portions having a semicircular shape such that the plurality of curved portions are connected to the front portions of the plurality of support members at first ends thereof, and a lateral front guard connected to second ends of the plurality of the plurality of curved portions, such that the lateral front guard extends perpendicularly across the second ends of the plurality of the plurality of curved portions.

The guard portion may further include a plurality of hinges disposed across the front brace to hingedly connect each of the plurality of curved portions to the plurality of support members.

The guard portion may further include a guard portion release lever disposed at a left side of the front brace to allow the plurality of hinges to unlock in response to depression of the guard portion release lever such that the guard portion hingedly rotates downward when the plurality of hinges are unlocked, and a guard portion locking lever disposed at a right side of the front brace to be connected to the guard portion release lever to cause the plurality of hinges to lock upon depression of the guard portion locking lever such that the guard portion is locked back in its original position when the plurality of hinges are locked.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1A:
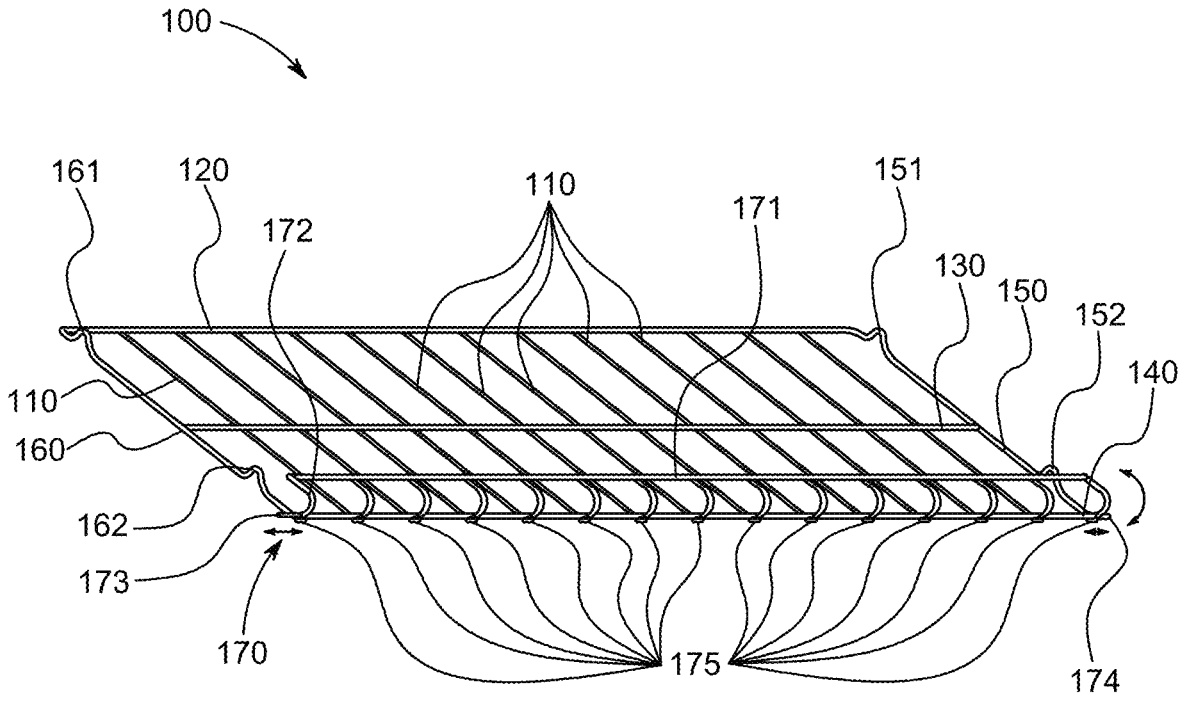
FIG. 1A illustrates a front angled perspective view an oven rack, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Oven Rack 100
Support Members 110

Rear Brace 120
Middle Brace 130
Front Brace 140
Right Brace 150
Right Rear Boss 151
Right Front Boss 152
Left Brace 160
Left Rear Boss 161
Left Front Boss 162
Guard Portion 170
Lateral Front Guard 171
Curved Portions 172
Guard Portion Release Lever 173
Guard Portion Locking Lever 174
Hinges 175

FIG. 1A illustrates a front angled perspective view an oven rack 100, according to an exemplary embodiment of the present general inventive concept.

Figure 1B:
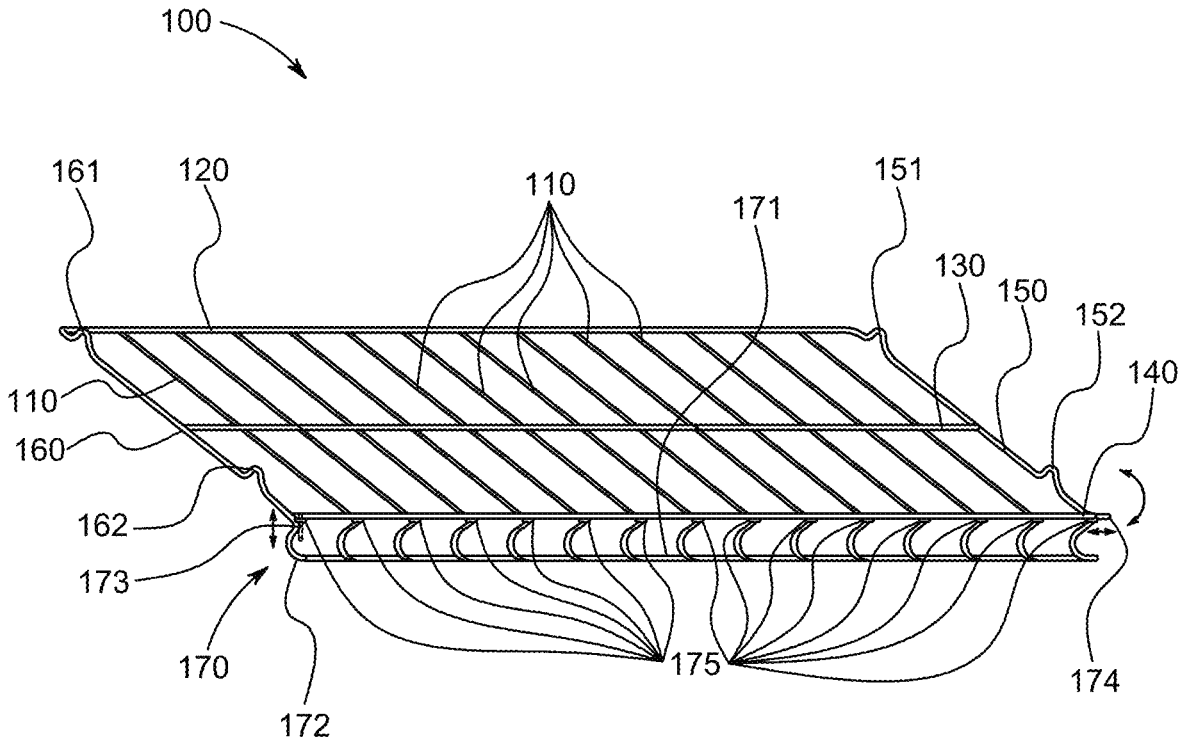
FIG. 1B illustrates a front angled perspective view an oven rack with a guard portion open, according to an exemplary embodiment of the present general inventive concept.

FIG. 1B illustrates a front angled perspective view an oven rack with a guard portion 170 open, according to an exemplary embodiment of the present general inventive concept.

The oven rack 100 may be constructed from at least one of metal, plastic, ceramic, glass, and rubber, etc., but is not limited thereto, and may be constructed from any type of material that can withstand extreme heat conditions.

The oven rack 100 is intended to be inserted into an oven (not illustrated), and may be constructed to hold cookware (e.g., pots, pans, baking pans, baking dishes, trays, etc.) thereupon.

The oven rack 100 may include a plurality of support members 110, a rear brace 120, a middle brace 130, a front brace 140, a right brace 150, a left brace 160, and a guard portion 170, but is not limited thereto.

The plurality of longitudinally extending elongated support members 110 may be disposed to be substantially parallel to each other, and also, may be positioned to be substantially parallel to and between the right brace 150 and the left brace 160.

The plurality of support members 110 may also be disposed perpendicularly with respect to the rear brace 120, the middle brace 130, and the front brace 140, which are respectively positioned longitudinally across the plurality of support members 110 at rear, middle, and front portions thereof. As such, the rear brace 120, the middle brace 130, and the front brace 140 may be connected to the plurality of support members 110 via welding, or the like.

The right brace 150 may be interconnected or otherwise integral with the rear brace 120, the middle brace 130, and the front brace 140, and may extend perpendicularly with respect to the rear brace 120, the middle brace 130, and the front brace 140. The right brace 150 extends between the forward and rear sections of the oven rack 100, and essentially acts as a support brace for other elements of the oven rack 100. Also, when the oven rack 100 is placed within an oven cavity, the right brace 150 may typically rest or otherwise be releasably secured on a rib or other conventional element of the oven cavity (not illustrated).

Corresponding to the right brace 150, the oven rack 100 also includes the left brace 160. The left brace 160 is parallel to the right brace 150 and is interconnected or otherwise integral with the rear brace 120, the middle brace 130, and the front brace 140. As with the right brace 150, the left brace 160 extends between the rear and front portions of the oven rack 100. As with the right brace 150, the left brace 160 rests upon or is otherwise releasably secured to a rib or similar component of the oven cavity (not illustrated).

The right brace 150 may include a right rear boss 151 and a right front boss 152, but is not limited thereto.

The left brace 160 may include a left rear boss 161 and a left front boss 162, but is not limited thereto.

The right rear boss 151, the right front boss 152, the left rear boss 161, and the left front boss 162 are conventional in many oven racks, and include a means for providing some securing forces when the oven rack 100 is in its conventional position within the oven cavity. That is, the right rear boss 151, the right front boss 152, the left rear boss 161, and the left front boss 162 will typically "mate" with corresponding indents located in ribs or ledges on each side surface of the oven cavity. With this type of mating relationship, the user may need to exert partially upwardly directed forces so as to lift the right rear boss 151, the right front boss 152, the left rear boss 161, and the left front boss 162 out of the indents when removing the oven rack 100 out of the oven cavity.

The guard portion 170 may include a lateral front guard 171, a plurality of curved portions 172, a guard portion release lever 173, a guard portion locking lever 174, and a plurality of hinges 175, but is not limited thereto.

The plurality of curved portions 172 may be connected directly to the plurality of support members 110.

The plurality of curved portions 172 may also be connected to the front brace 140 at first ends thereof, and may be connected to the lateral front guard 171 at second ends thereof.

As such, if an object (e.g., baking tray) were disposed on the support members 110 and for some reason were to slide forward toward a front portion of the oven rack 100, the lateral front guard 171 would contact the baking tray and prevent the object from falling off a front end of the oven rack 100.

The plurality of hinges 175 may be disposed along the front brace 140 to hingedly connect the plurality of curved portions 172 to the plurality of support members 110.

The guard portion release lever 173 may be disposed at a left side of the front brace 140, and the guard portion locking lever 174 may be disposed at a right side of the front brace 140.

Also, the guard portion release lever 173 may be connected to the guard portion locking lever 174 and throughout and within the front brace 140.

Accordingly, if a user pushes on the guard portion release lever 173, the plurality of hinges 175 may release the guard portion 170, such that it hingedly rotates downward to allow a user to easily slide an object (e.g., a pot) across the support members 110 from a rear portion of the oven rack 110 towards and out from a front portion of the oven rack 110.

After the user has removed the object off of the oven rack 110, the user may hingedly rotate the guard portion 170 upwards and push the guard portion locking lever 174 to lock the guard portion 170 back into place.

The present general inventive concept may include an oven rack 100, including a plurality of support members 110 to support an object thereupon, a rear brace 120 connected to rear portions of the plurality of support members 110 such that the rear brace 120 is disposed perpendicularly with respect to the plurality of support members 110, a front brace 140 connected to front portions of the plurality of support members 110 such that the front brace 140 is disposed perpendicularly with respect to the plurality of support members 110, and a guard portion 170 connected to the front portions of the plurality of support members 110, the guard portion 170 including a plurality of curved portions 172 having a semicircular shape such that the plurality of curved portions 172 are connected to the front portions of the plurality of support members 110 at first ends thereof, and a lateral front guard 171 connected to second ends of the plurality of the plurality of curved portions 172, such that the lateral front guard 171 extends perpendicularly across the second ends of the plurality of the plurality of curved portions 172.

The guard portion 170 may further include a plurality of hinges 175 disposed across the front brace 140 to hingedly connect each of the plurality of curved portions 172 to the plurality of support members 110.

The guard portion 170 may further include a guard portion release lever 173 disposed at a left side of the front brace 140 to allow the plurality of hinges 175 to unlock in response to depression of the guard portion release lever 173 such that the guard portion 170 hingedly rotates downward when the plurality of hinges 175 are unlocked, and a guard portion locking lever 174 disposed at a right side of the front brace 140 to be connected to the guard portion release lever 173 to cause the plurality of hinges 175 to lock upon depression of the guard portion locking lever 174 such that the guard portion 170 is locked back in its original position when the plurality of hinges 175 are locked.

A purpose of the present general inventive concept is to provide users with an improved oven rack design that prevents cookware slippage and promotes kitchen safety. The present general inventive concept introduces a novel 2.5" gate/hook in the front of the oven rack that acts as a guard, preventing cookware, pots, and pans from sliding off the rack when users pull them out partially to check, stir, or manipulate their food. Moreover, with this oven improvement users will no longer need to awkwardly balance their cookware with one hand while trying to manage lids, foil, or other oven-related tasks with the other spare hand. The gate secures the cookware in place, allowing users to tend to other tasks with ease. Beyond preventing potential spills, the present general inventive concept contributes to kitchen safety as it helps mitigate the risk of accidental burns that may occur when dealing with hot cookware in the oven. This innovative, top-quality product serves to prevent accidents and burns by keeping cookware steady and secure during oven use; thus, eliminating the stress associated with cookware sliding off oven racks. As a result, the present general inventive concept may prove to be essential in the household industry.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An oven rack, comprising:

a plurality of support members to support an object thereupon;

a rear brace connected to rear portions of the plurality of support members such that the rear brace is disposed perpendicularly with respect to the plurality of support members;

a front brace connected to front portions of the plurality of support members such that the front brace is disposed perpendicularly with respect to the plurality of support members; and a guard portion connected to the front portions of the plurality of support members, the guard portion comprising:

a plurality of curved portions having a semicircular shape such that the plurality of curved portions are connected to the front portions of the plurality of support members at first ends thereof, a lateral front guard connected to second ends of the plurality of the plurality of curved portions, such that the lateral front guard extends perpendicularly across the second ends of the plurality of the plurality of curved portions, and a plurality of hinges disposed across the front brace to hingedly connect each of the plurality of curved portions to the plurality of support members wherein the guard portion further comprises:

a guard portion release lever disposed at a left side of the front brace to allow the plurality of hinges to unlock in response to depression of the guard portion release lever such that the guard portion hingedly rotates downward when the plurality of hinges are unlocked; and a guard portion locking lever disposed at a right side of the front brace to be connected to the guard portion release lever to cause the plurality of hinges to lock upon depression of the guard portion locking lever such that the guard portion is locked back in its original position when the plurality of hinges are locked.

* * * * *